US010190816B2

(12) United States Patent
Lu et al.

(10) Patent No.: US 10,190,816 B2
(45) Date of Patent: Jan. 29, 2019

(54) DOOR FOR REFRIGERATOR AND REFRIGERATOR

(71) Applicant: BSH HAUSGERAETE GMBH, Munich (DE)

(72) Inventors: Songtao Lu, Chuzhou (CN); Zhishan Lu, Chuzhou (CN); Ping Lv, Nanjing (CN); Xiangfei Yang, Nanjing (CN); Chuan Zhang, Chuzhou (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/680,338

(22) Filed: Aug. 18, 2017

(65) Prior Publication Data

US 2018/0051926 A1 Feb. 22, 2018

(30) Foreign Application Priority Data

Aug. 19, 2016 (CN) ..... 2016 1 0700296

(51) Int. Cl.
*F25D 23/02* (2006.01)
*F25D 29/00* (2006.01)

(52) U.S. Cl.
CPC ..... *F25D 23/028* (2013.01); *F25D 23/02* (2013.01); *F25D 29/005* (2013.01); *F25D 2400/06* (2013.01); *F25D 2400/18* (2013.01); *F25D 2400/361* (2013.01)

(58) Field of Classification Search
CPC ..... F25D 23/028; F25D 29/005
See application file for complete search history.

(56) References Cited

U.S. PATENT DOCUMENTS 3,995,349 A * 12/1976 Roberts ..... A47B 95/02 16/412
4,408,432 A * 10/1983 Carter ..... E05B 1/0015 293/128
4,745,656 A * 5/1988 Revlett ..... E05B 1/0015 16/412
5,493,756 A * 2/1996 Shanok ..... A47B 95/02 16/412
5,740,587 A 4/1998 Onai et al.
5,832,564 A * 11/1998 Shanok ..... A47B 95/02 16/436

(Continued)

FOREIGN PATENT DOCUMENTS

CN 2583586 Y 10/2003
CN 102341665 A 2/2012

(Continued)

*Primary Examiner* — Hanh V Tran
(74) *Attorney, Agent, or Firm* — Laurence A. Greenberg; Werner H. Stemer; Ralph E. Locher

(57) ABSTRACT

A door for a refrigerator includes a door housing, which is provided with a thermal insulation material therein, where the thermal insulation material is combined with the door housing. The door housing has a concave portion recessed backwards from a front surface of the door, where one end of the concave portion is provided with a ramp that extends forwards. A detachable member is provided and is isolated from the thermal insulation material and is connected to the door housing. Accordingly, at least one part of the ramp is formed by the detachable member.

15 Claims, 4 Drawing Sheets

(56) References Cited

U.S. PATENT DOCUMENTS

| | | | | |
|---|---|---|---|---|
| 6,609,274 | B2 * | 8/2003 | Christensen | E05B 1/0015 16/412 |
| 7,410,230 | B2 * | 8/2008 | Anderson | F25D 23/065 312/401 |
| 8,398,186 | B2 | 3/2013 | Higami | |
| 2011/0273071 | A1 * | 11/2011 | Kim | F25D 23/028 312/405 |
| 2011/0315694 | A1 * | 12/2011 | Kurita | F25D 23/025 220/592.09 |
| 2012/0038258 | A1 * | 2/2012 | Park | E05D 7/0027 312/405 |

FOREIGN PATENT DOCUMENTS

| | | | |
|---|---|---|---|
| DE | 102015208243 | A1 | 11/2016 |
| EP | 0781971 | A1 | 7/1997 |
| EP | 2159521 | A1 | 3/2010 |
| EP | 2405216 | A1 | 1/2012 |
| JP | H114248 | A | 1/1999 |
| JP | 2012042180 | A | 3/2012 |

* cited by examiner

DOOR FOR REFRIGERATOR AND REFRIGERATOR

CROSS-REFERENCE TO RELATED APPLICATION

This application claims the benefit, under 35 U.S.C. § 119, of Chinese patent application CN 201610700296.7, filed Aug. 19, 2016; the prior application is herewith incorporated by reference in its entirety.

BACKGROUND OF THE INVENTION

Field of the Invention

The present invention relates to a door for a refrigerator and a refrigerator, and in particular, to a door having a cover connected to a door housing and a household refrigerator having such a door.

Published, Chinese patent application CN102341665A discloses a refrigerator door, which has a concave portion and a user operation/display panel adjacent to the concave portion. One end of the concave portion is provided with a ramp, and a tail end of the ramp is flush to the user operation/display panel having a flat and straight front surface. An inner side of a component that forms the concave portion is combined with a thermal insulation material, to ensure the strength of the component.

When the refrigerator door has a front panel made of a glass plate/ceramic plate/resin plate, or the like, during the manufacturing process, the front panel may be pressed on a ramp due to a manufacturing deviation, causing damages to the front panel, and consequently, the front panel is scrapped.

SUMMARY OF THE INVENTION

An objective of the present invention is to provide an improved door for a refrigerator, and a refrigerator having such a door.

Another objective of the present invention is to provide a door, which is easy to manufacture, for a refrigerator, and a refrigerator having such a door.

A first aspect of the present invention relates to a door for a refrigerator. The door includes a door housing, which is provided with a thermal insulation material therein, where the thermal insulation material is combined with the door housing. A concave portion is recessed backwards from a front surface of the door, where one end of the concave portion is provided with a ramp that extends forwards. A detachable member isolated from the thermal insulation material is provided and connected to the door housing. At least one part of the ramp is formed by the detachable member.

Because at least one part of the ramp is formed by the detachable member isolated from the thermal insulation material, the datable member may be further connected to the door housing after a procedure of injecting the thermal insulation material into the door housing. Regardless of whether the door housing includes a front panel made of a glass plate/ceramic plate/resin plate, or the like or whether the front panel made of a glass plate/ceramic plate/resin plate, or the like is pressed on the door housing, the possibility that the front panel is pressed on the ramp due to a manufacturing error can be avoided as long as the detachable member that forms at least one part of the ramp is assembled on the door after the front panel. Further, manufacturers can design manufacturing procedures that are similar to a greatest degree according to requirements, to manufacture a door having such a front panel and a door without such a front panel, so as to facilitate manufacturing of a refrigerator door.

It should be understood that the "detachable member" of the present invention refers to a component that can be detached from the door by a user or a maintenance person by hands or a common/specific tool without damaging the refrigerator door.

It should be understood that at least one part of the "ramp" may be a plane and/or a curved surface.

In a possible embodiment, the concave portion is provided along a longitudinal side of the door. In an optional embodiment, the concave portion is provided along a horizontal side of the door, such as a top portion or a bottom portion.

Other features that are separately considered as attributes of the present invention or are combined with other features to be considered as attributes of the present invention will be described in the following additional claims.

Although it is possible that the detachable member is dedicated to forming the ramp and is connected to the door housing, in a preferred embodiment, the detachable member includes a cover connected to the door housing, where the cover is used to cover an accommodating cavity adjacent to the concave portion; the cover includes an extension portion that extends towards the concave portion, and the extension portion forms at least one part of the ramp. In this way, the cover near the concave portion can be used to form at least one part of the ramp, so that the detachable member that is used to be isolated from the thermal insulation material and form at least one part of the ramp can be formed without adding additional components.

In a possible embodiment, a user interface electrical module that is at least partially accommodated in the accommodating cavity is included.

In a possible embodiment, the door housing includes a first positioning portion that is located outside the accommodating cavity and used to position the extension portion in at least one direction. Compared with that a cover is usually fixed in a door housing by using a mechanism located in an accommodating cavity in the prior art, in the present implementation, the cover can be additionally positioned outside the accommodating cavity by using the extension portion, so as to facilitate accurate positioning between the cover and the door housing, for example, facilitate making a gap between the cover and the door housing more uniform, and this can be predicted.

In a possible embodiment, one of the door housing and the extension portion is provided with an insertion groove located behind the ramp, and the other one of the door housing and the extension portion is provided with an insertion portion inserted into the insertion groove.

In a possible embodiment, at least two of the insertion portions that are spaced are included, where a first positioning portion located between adjacent insertion portions for positioning the extension portion in at least one direction is provided in the insertion groove.

In a possible embodiment, the insertion portion is formed by a raise block located on a tail end of the extension portion.

In a possible embodiment, the cover includes a substrate portion; the user interface electrical module is located on a rear side of the substrate portion; and the extension portion is bent inwards from one end of the substrate portion and extends towards the concave portion.

In a possible embodiment, a curved surface performs transition between the substrate portion and the extension portion.

In a possible embodiment, the ramp includes a first ramp portion formed by the door housing and a second ramp portion formed by the detachable member, where at least one part of the second ramp portion protrudes more forwards than the first ramp portion. Therefore, when the detachable member is not assembled on the door housing, the height of the door housing on the corresponding second ramp portion is reduced, so as to prevent the front panel from being pressed on the ramp when the front panel needs to be installed.

In a possible embodiment, the door housing includes the insertion groove located on an inner side of the first ramp portion, and the detachable member includes the insertion portion inserted into the insertion groove.

In a possible embodiment, a front panel is included, where an edge of the front panel is provided with an opening that corresponds to the concave portion and the detachable member, and a front surface of the front panel is flush to a front surface of the detachable member. The front panel may be formed of a material, such as glass, resin, or ceramic. In an embodiment, when there is a foamed thermal insulation material in the door, the front panel can be used as a part of the door housing and directly contact the thermal insulation material. In another embodiment, the front panel is connected in front of the door housing, that is, a door plate contacting the thermal insulation material is provided on a rear side of the front panel; the front panel is fixed (for example, pasted) on the door after a foaming procedure of the door ends.

In a possible embodiment, the door housing includes a handle groove in communication with the concave portion.

In a possible embodiment, multiple buckle structures that are spaced along a length direction of the cover and are used to perform a buckling connection on the cover to the door housing are provided between the door housing and the cover. A positioning structure is separately provided between the door housing and two ends of the cover. The positioning structure positions the cover in a width direction of the cover. In this way, the gap between the cover and the door housing can be accurately and uniformly controlled, thereby facilitating the texture of the door.

Another aspect of the present invention relates to a refrigerator. The refrigerator includes any one of the foregoing doors.

It should be understood that the present invention may be applicable to various refrigerators with different structures, and should not be limited to the preferred embodiments disclosed in the present invention. For example, the present invention may be applicable to a side-by-side refrigerator having a first storage compartment and a second storage compartment that are distributed side by side, may be applicable to a refrigerator having a first storage compartment and a second storage compartment that are vertically distributed, and or may be applicable to a refrigerator, in which a pair of doors closes a same storage compartment. A storage compartment of a refrigerator may be used to store food and/or wine. For example, the refrigerator may have at least one storage compartment purely used for storing wine.

The door may be a rotatable door pivotally connected to a body of the refrigerator, or may be a drawer-type door pushably connected to the body. The door may close one or more storage compartments of the refrigerator, or may close a part of one or more storage compartments.

The structures of the present invention and other inventive objectives and beneficial effects of the present invention will be comprehensible by describing preferred embodiments with reference to the accompanying drawings.

Other features which are considered as characteristic for the invention are set forth in the appended claims.

Although the invention is illustrated and described herein as embodied in a door for refrigerator and a refrigerator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
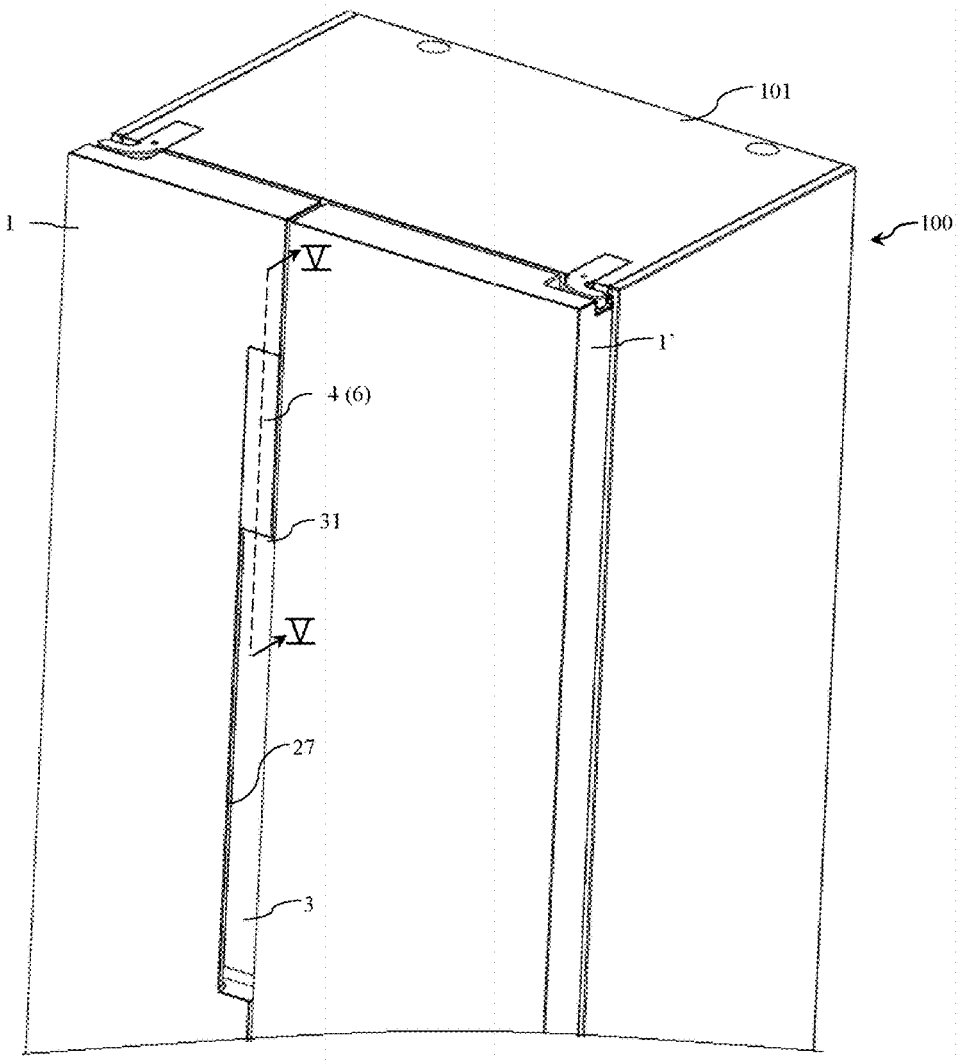
FIG. 1 is a partial perspective view of a refrigerator according to a preferred embodiment of the present invention.

Referring now to the figures of the drawings in detail and first, particularly to FIG. 1 thereof, there is shown a diagrammatic, perspective view of a refrigerator 100 according to a preferred embodiment of the present invention. As shown in FIG. 1, the refrigerator 100 includes a body 101 having a first storage compartment (not shown in the figure) and a second storage compartment (not shown in the figure) that are provided side by side. The refrigerator 100 further includes a pair of side-by-side doors 1 connected to the body 101 to respectively close corresponding storage compartments.

Figure 2:
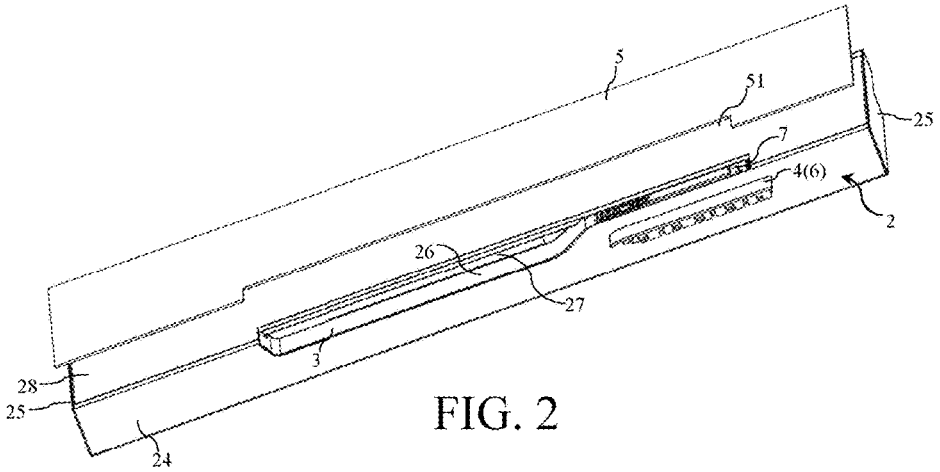
FIG. 2 is a partial, perspective exploded view of a door according to a preferred embodiment of the present invention.
Figure 3:
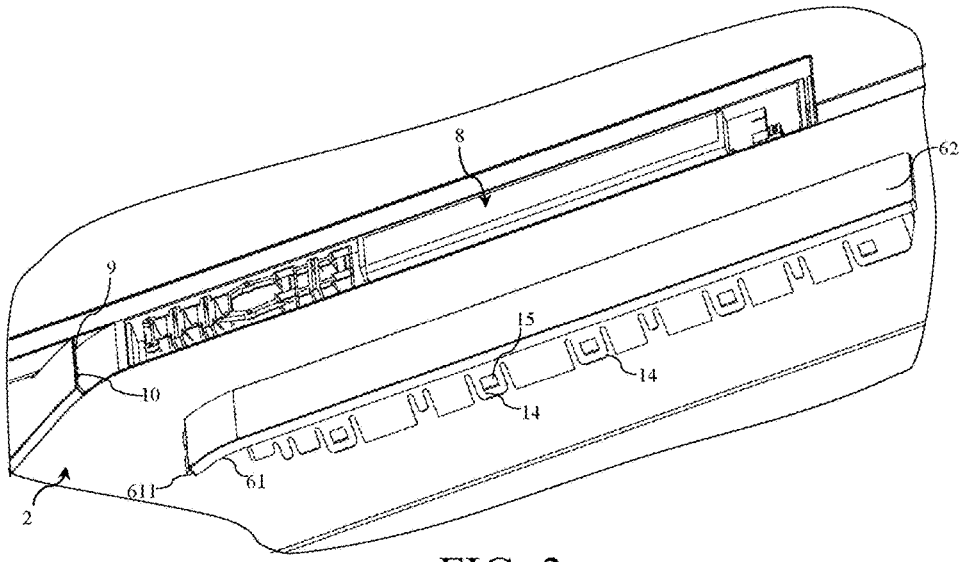
FIG. 3 is a partial schematic enlarged view of the door shown in FIG. 2.
Figure 5:
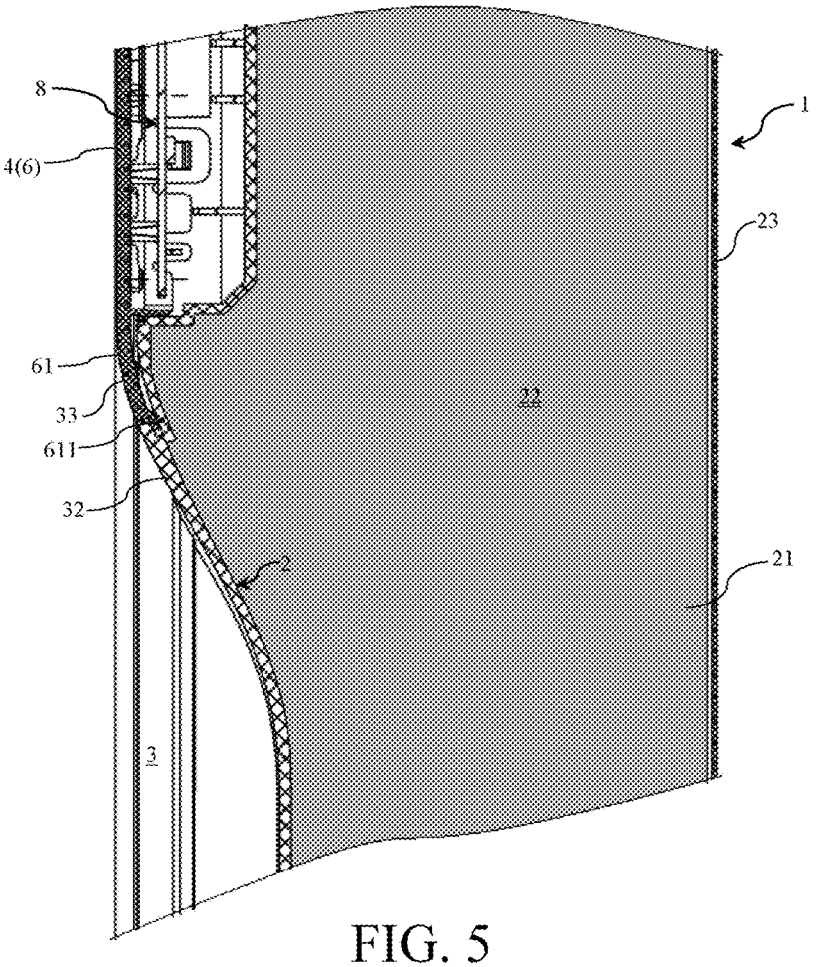
FIG. 5 is a sectional view along the line V-V shown in FIG. 1.

Referring to FIG. 1, FIG. 2, and FIG. 5, the door 1 includes a door housing 2, which includes a thermal insulation space 22 filled with a thermal insulation material 21. The thermal insulation material 21 is combined with an inner side of the door housing 2.

In this embodiment, the door housing 2 may include a door inner wall 23, a front wall 28 located in front of the door inner wall 23 and spaced, by a distance, from the door inner wall 23, a pair of upright columns 24, connecting the door inner wall 23 to a front wall 28, on a longitudinal side and a pair of transverse covers 25, connecting the door inner wall 23 to the front wall 28, on a transverse side.

The door housing 2 may further include a handle member 26 connected to one of the upright columns 24. The handle member 26 includes a handle groove 27.

The door inner wall 23, the front wall 28, the upright columns 24, the transverse covers 25, and the handle member 26 enclose into the thermal insulation space 22 as a part of the door housing 2. The components are undetachably combined with the thermal insulation material 21. Because the components are closely connected to the thermal insulation material 21, they cannot be detached from the door 1 without damaging the door 1.

It should be understood that the door housing 2 may also have a structure different from that of this embodiment. For example, the front wall 28 and the upright columns 24 and/or the transverse covers 25 may be formed by a single component.

The door 1 includes a front panel 5 connected in front of the door housing 2. The front panel 5 forms at least an overwhelming majority of a front surface of the door 1.

The front panel 5 may be formed of a material, such as glass, resin, or ceramic. The front panel 5 may be pasted on a front surface of the door housing 2.

The door 1 includes a concave portion 3 recessed backwards from the front surface of the door 1. In this embodiment, the concave portion 3 is in communication with a handle groove 27. A user stretches a hand into the handle groove 27 through the concave portion 3.

One end of the concave portion 3 is provided with a ramp 31 extending forwards. In this embodiment, a most forward part of the ramp 31 may be located at a position flush to the front surface of the door 1.

The door 1 includes a detachable member 4 that is isolated from the thermal insulation material 21 and connected to the door housing 2. At least one part of the ramp 31 is formed by the detachable member 4. Further, the most forward part of the ramp 31 is formed by the detachable member 4.

A side edge of the front panel 5 extends along the concave portion 3. When the front panel 5 is connected to the door housing 2, the front panel 5 may be pressed on the ramp 31, causing damages to the front panel 5. According to this embodiment of the present invention, at least one part of the ramp 31 is formed by the detachable member 4. Because the detachable member 4 is isolated from the thermal insulation material 21, the detachable member 4 may be connected to the door housing 2 after the front panel 5 is connected to the door housing 2, so that the height of the door housing 2 on the corresponding ramp 31 in the thickness direction of the door 1 can be reduced because the detachable member 4 has not been assembled on the door 1 when the front panel 5 is connected to the door housing 2, thereby preventing the front panel 5 from being carelessly pressed on the ramp 31 and preventing the front panel 5 from being damaged.

The detachable member 4 may include a cover 6 connected to the door housing 2. The cover 6 is used to cover an accommodating cavity 7 adjacent to the concave portion 3. The cover 6 includes an extension portion 61 that extends towards the concave portion 3. The extension portion 61 forms at least one part of the ramp 31.

The door 1 includes a user interface electrical module 8 that is at least partially accommodated in the accommodating cavity 7. The user interface electrical module 8 may include an input unit used to receive an instruction input by the user and/or an output unit for displaying information to the user. The user interface electrical module 8 may include a control circuit board connected to the input unit and/or the output unit.

For example, the user interface electrical module may include a touch unit to receive a touch instruction of the user. In an optional embodiment, the user interface electrical module may alternatively receive the instruction of the user by using other input apparatuses such as keys.

The cover 6 includes a substrate portion 62. The user interface electrical module 8 is located on a rear side of the substrate portion 62. The user interface electrical module 8 may be fixed on the rear side of the substrate portion 62.

The extension portion 61 is bent inwards from one side, close to the concave portion 3, of the substrate portion 62 and extends towards the concave portion 3.

A side edge of the front panel 5 is provided with an opening corresponding to the concave portion 3 and the detachable member 4-cover 6. A front surface of the front panel 5 may be flush to a front surface of the substrate portion 62.

In this embodiment, a part of the ramp 31 is formed by the door housing 2 undetachably combined with the thermal insulation material 21, and a part of the ramp 31 is formed by the detachable member 4. Therefore, the ramp 31 includes a first ramp portion 32 formed by the door housing 2 and a second ramp portion 33 formed by the detachable member 4. Further, at least one part of the second ramp portion 33 protrudes more forwards than the first ramp portion 32. The most forward part of the ramp 31 may be formed by the second ramp portion 33.

The second ramp portion 33 includes a curved surface, so that a smooth curved surface performs seamless transition between the first ramp portion 32 and the front surface of the substrate portion 62.

The door housing 2 includes an insertion groove 9 located behind the ramp 31. The extension portion 61 includes an insertion portion 611 inserted into the insertion groove 9.

In this embodiment, the insertion groove 9 is located on an inner side of the first ramp portion 32. The insertion portion 611 located on the detachable member 4 is inserted into the insertion groove 9. The insertion portion 61 may be formed by a raise block located on a tail end of the extension portion 61.

The tail end of the extension portion 61 is provided with at least two insertion portions 611 that are spaced. A first positioning portion 10 that is located between the adjacent insertion portions 611 and used to position the extension portion 61 in a width direction of the cover 6 is provided in the insertion groove 9.

Because the door housing 2 includes the first positioning portion 10 that is located outside the accommodating cavity 7 and used to position the extension portion 61 so as to position the cover 6 (the detachable member 4), a gap between the cover 6 (the detachable member 4) and the door housing 2 can be controlled more accurately and uniformly.

Figure 4:
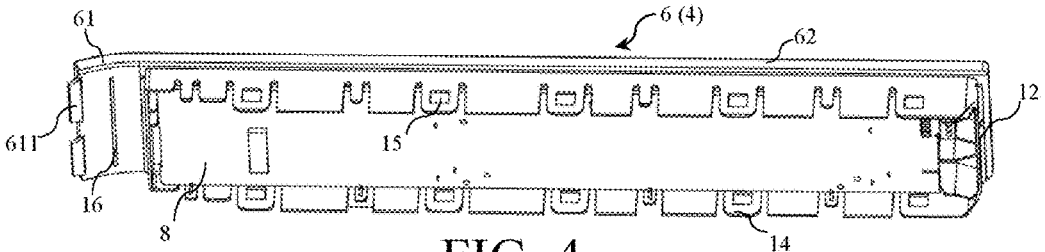
FIG. 4 is a schematic perspective view of a cover according to a preferred embodiment of the present invention.
Figure 6:
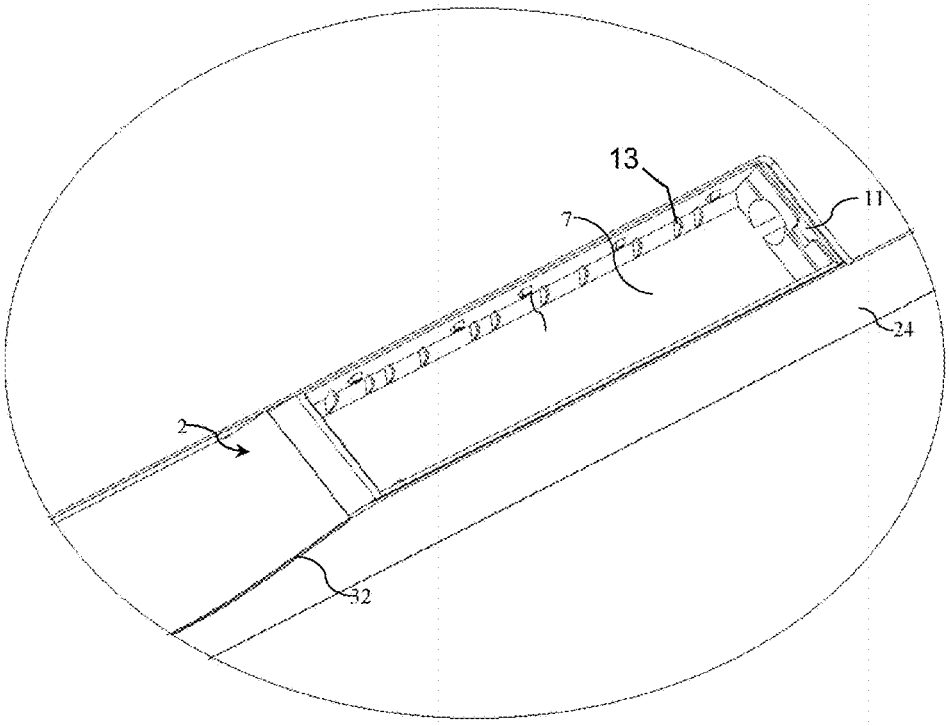
FIG. 6 is a schematic enlarged perspective view of a door of an electrical appliance according to a preferred embodiment of the present invention, where a cover is removed.

As shown in FIG. 4 and FIG. 6, a positioning structure that positions the cover 6 in the width direction of the cover 6 is further provided on one end, far from the concave portion 3, of the door housing 2 and the cover 6. The positioning structure includes a positioning port 11 located on one end, far from the concave portion 3, of the accommodating cavity 7, and a protruding portion 12 located on one end, opposite to the extension portion 61, of the cover 6 and matching the positioning port 11. It should be understood that in other embodiments, positions of the positioning port 11 and the protruding portion 12 may alternatively be exchanged with each other.

Multiple buckle structures that are spaced along a length direction of the cover 6 and are used to perform a buckling connection on the cover 6 to the door housing 2 are provided between the door housing 2 and the cover 6. The buckle structure includes multiple protrusions 13 provided on an inner wall of the accommodating cavity 7 and multiple elastic arms 14 that extend from an inner side of the substrate portion 62 inwards and have elasticity. The elastic arm 14 is provided with multiple clamping ports 15 for receiving the protrusions 13.

In this way, the cover 6 is fixed by the buckle structures along a length direction of the cover 6, and two ends of the cover 6 are positioned in the width direction of the cover 6.

As shown in FIG. 4 and FIG. 5, an inner side of the extension portion 61 is provided with a protruding rib 16, which abuts against the front surface of the door housing 2, so as to prevent the extension portion 61 from deforming upon a force.

In the foregoing embodiments, only after a foaming agent is injected into the door housing 2 and hardened into the thermal insulation material 21, the front panel 5 is connected to the door housing 2; that is, the front panel 5 does not participate in the foaming process of the door 1. Then, in an optional embodiment, the front panel 5 may alternatively be used as a part of the door housing and is closely combined with the thermal insulation material 21. For example, before the foaming process, the front panel 5 is connected to a door frame to form a front boundary of a thermal insulation space; in the foaming process, the terminal insulation material is closely connected to the front panel 5.

Various embodiments of single parts descried with reference to FIG. 1 to FIG. 6 may be combined with each other in any given manner to implement advantages of the present invention. In addition, the present invention is not limited to the shown embodiments, and generally, other means except the shown means may also be used, as long as the means can also achieve the same effect.

The invention claimed is:

1. A door for a refrigerator, the door comprising:

a door housing defining a front surface of the door;

a thermal insulation material disposed in said door housing, wherein said thermal insulation material is combined with said door housing;

a concave portion recessed backwards from said front surface of the door, wherein one end of said concave portion has a ramp extending forwards; and a detachable member isolated from said thermal insulation material and connected to said door housing, at least one part of said ramp is formed by said detachable member, said at least one part of said ramp being inclined relative to said front surface of the door.

2. The door according to claim 1, wherein:

said door housing has an accommodating cavity formed therein and disposed next to said concave portion; and said detachable member has a cover connected to said door housing, said cover is used to cover said accommodating cavity adjacent to said concave portion, said cover has an extension portion that extends towards said concave portion, and said extension portion forms said at least one part of said ramp.

3. The door according to claim 2, further comprising a user interface electrical module that is at least partially accommodated in said accommodating cavity.

4. The door according to claim 2, wherein said door housing contains a first positioning portion that is disposed outside said accommodating cavity and used to position said extension portion in at least one direction.

5. The door according to claim 2, wherein one of said door housing or said extension portion has an insertion groove formed therein and disposed behind said ramp, and the other one of said door housing and said extension portion is provided with an insertion portion inserted into said insertion groove.

6. The door according to claim 5, wherein said insertion portion is one of at least two insertion portions that are spaced apart; and further comprising a first positioning portion disposed between adjacent said insertion portions for positioning said extension portion in at least one direction and provided in said insertion groove.

7. The door according to claim 5, wherein said insertion portion is formed by a raise block disposed on a tail end of said extension portion.

8. The door according to claim 3, wherein:

said cover has a substrate portion;

said user interface electrical module is disposed on a rear side of said substrate portion; and said extension portion is bent inwards from one end of said substrate portion and extends towards said concave portion.

9. The door according to claim 1, wherein said ramp contains a first ramp portion formed by said door housing and a second ramp portion formed by said inclined part of said detachable member, wherein at least one part of said second ramp portion protrudes more forwards than said first ramp portion.

10. The door according to claim 9, wherein said second ramp portion has a curved surface.

11. The door according to claim 9, wherein:

said door housing has an insertion groove formed therein and disposed on an inner side of said first ramp portion; and said detachable member has an insertion portion inserted into said insertion groove.

12. The door according to claim 1, further comprising a front panel having an edge with an opening formed therein corresponding to said concave portion and said detachable member, said front panel having a front surface being flush to at least one part of a front surface of said detachable member.

13. The door according to claim 1, wherein said door housing has a handle groove formed therein and in communication with said concave portion.

14. The door according to claim 2, further comprising:

multiple buckle structures that are spaced along a length direction of said cover and are used to perform a buckling connection on said cover to said door housing are disposed between said door housing and said cover; and a positioning structure is separately provided between said door housing and two ends of said cover, said positioning structure positions said cover in a width direction of said cover.

15. A refrigerator, comprising:

a door having a front surface, said door containing:

a door housing;

a thermal insulation material disposed in said door housing, said thermal insulation material is combined with said door housing;

a concave portion recessed backwards from said front surface of said door, wherein one end of said concave portion has a ramp extending forwards; and a detachable member isolated from said thermal insulation material and connected to said door housing, at least one part of said ramp is formed by said detachable member, said at least one part of said ramp being inclined relative to said front surface of said door.

* * * * *